United States Patent [19]

Stevens

[11] Patent Number: 5,058,839

[45] Date of Patent: Oct. 22, 1991

[54] TRASH BAG HOLDER

[76] Inventor: Harry C. Stevens, Box 128, Almena, Kans. 67622

[21] Appl. No.: 149,007

[22] Filed: Jan. 27, 1988

[51] Int. Cl.[5] ..... B65B 67/00

[52] U.S. Cl. ..... 248/97; 248/101; 248/150

[58] Field of Search ..... 248/97, 99, 101, 95, 248/150, 155.4, 188.6, 166, 136, 165

[56] References Cited

U.S. PATENT DOCUMENTS

| | | | |
|---|---|---|---|
| 651,773 | 6/1900 | Smith | 248/97 |
| 1,278,385 | 9/1918 | Rickard | 248/94 |
| 3,095,172 | 6/1963 | Dwyer | 248/97 |
| 3,231,053 | 1/1966 | Rutkowski | 248/188.6 X |
| 3,779,419 | 12/1973 | Heitz | 248/99 X |
| 3,796,402 | 3/1974 | Trotta | 248/97 |
| 3,893,649 | 7/1975 | Cornell et al. | 248/99 |
| 4,069,993 | 1/1978 | Shanks | 248/101 X |
| 4,157,801 | 6/1979 | Elmer | 248/97 |
| 4,171,132 | 10/1979 | Kassai | 248/188.6 X |
| 4,171,847 | 10/1979 | Tukui | 248/188 X |
| 4,599,832 | 7/1986 | Benton et al. | 5/99 R X |

FOREIGN PATENT DOCUMENTS

| | | | |
|---|---|---|---|
| 961637 | 11/1949 | France | 248/95 |

*Primary Examiner*—Karen J. Chotkowski

*Attorney, Agent, or Firm*—John Wade Carpenter

[57] ABSTRACT

A trash bag holder having a pair of circular support members interconnected by a pair of legs. The legs pivot at their respective midpoints such that the trash bag can be collapsed into a folded position for easy storage or carrying.

5 Claims, 4 Drawing Sheets

Fig. 5
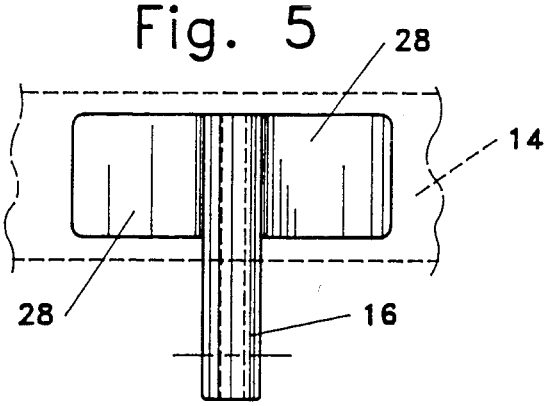
Fig. 6
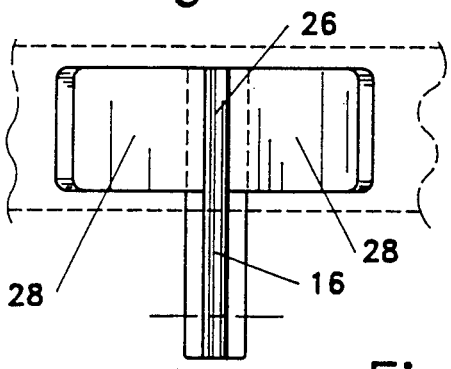
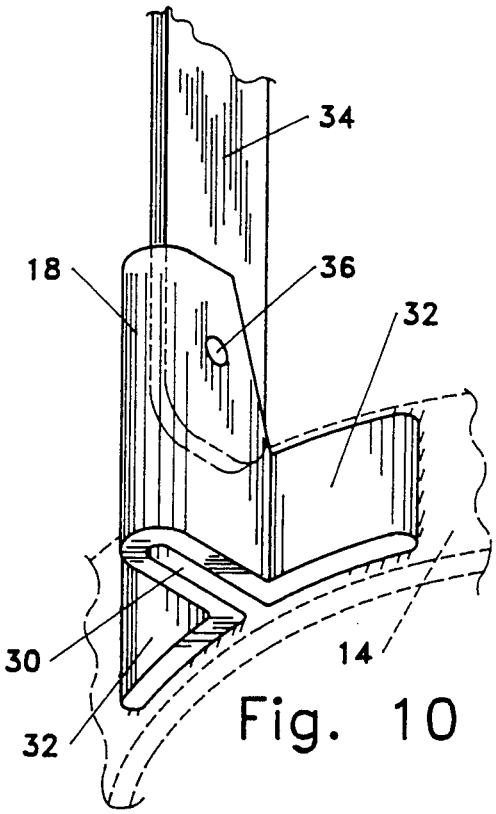
Fig. 10
Fig. 7
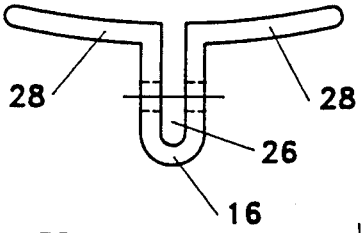
Fig. 8
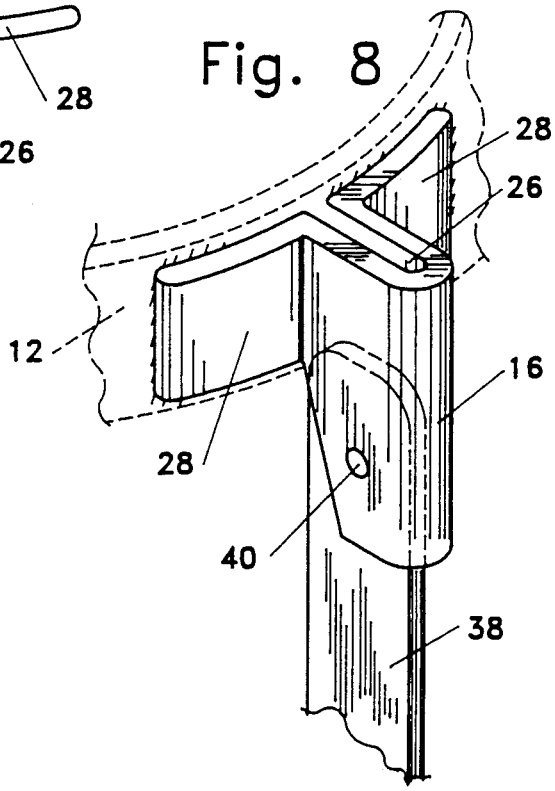
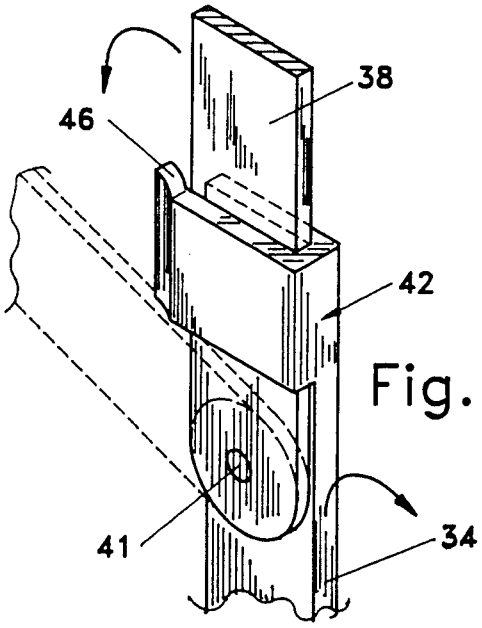
Fig. 9

Fig.11
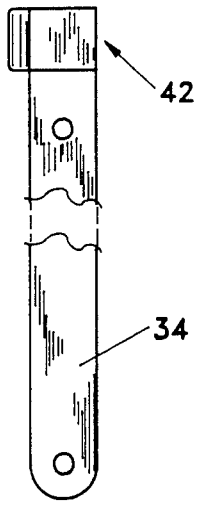
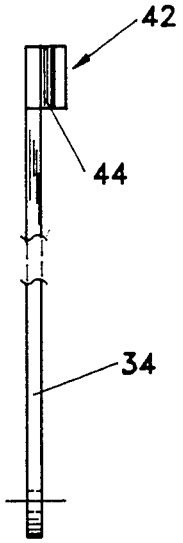
Fig.12
Fig.13
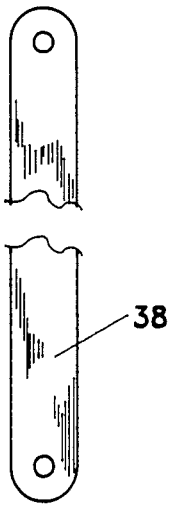
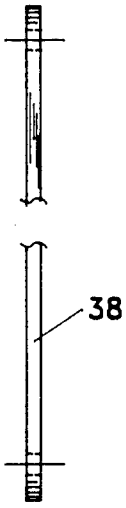
Fig.14
Fig.15
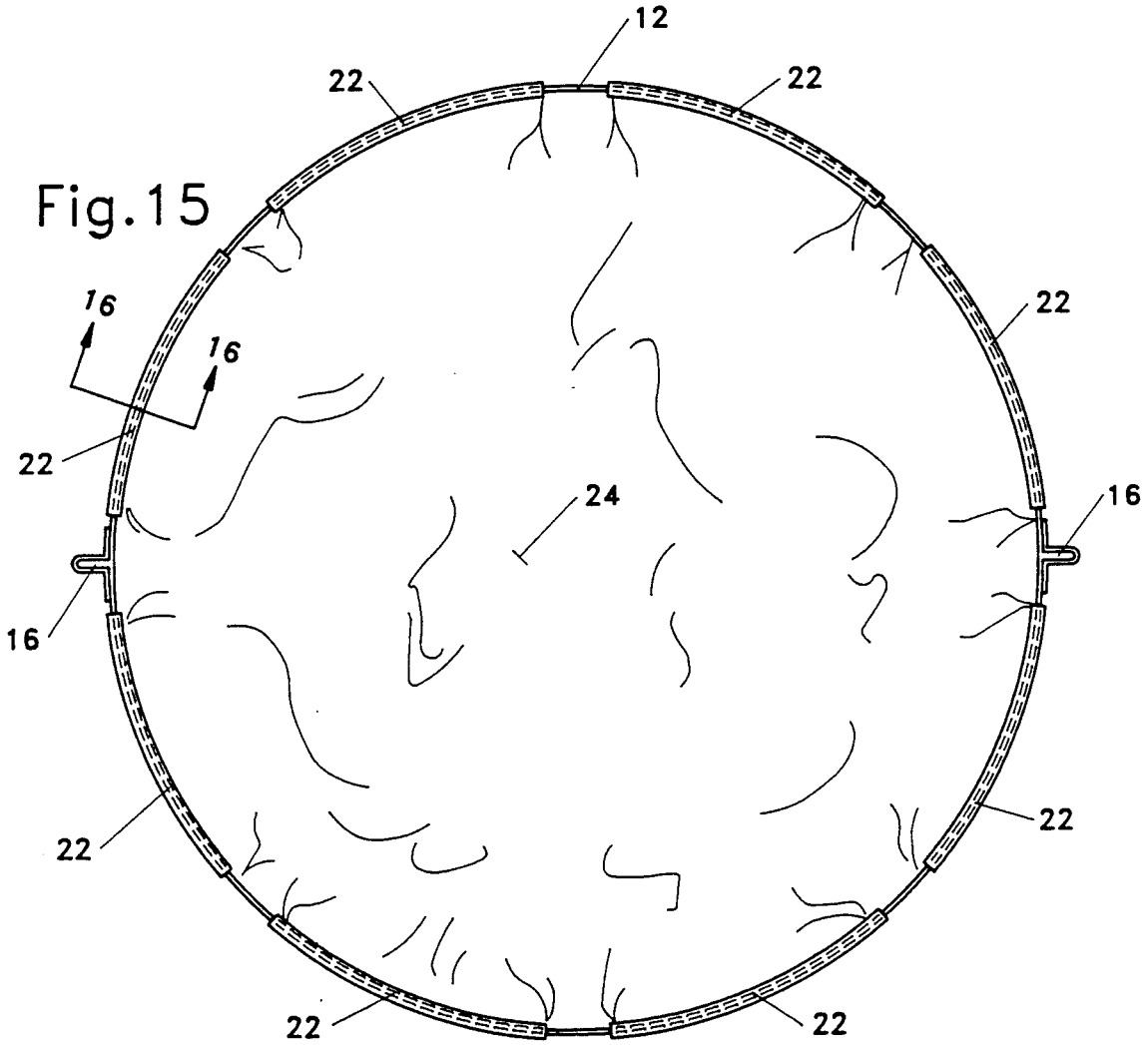

TRASH BAG HOLDER

FIELD OF THE INVENTION

The present invention is related to a trash bag holder which is capable of holding flexible bags, such as the kind used to hold leaves and the like.

BACKGROUND OF THE INVENTION

The following U.S. patents by numbers were discovered in a patentability search: U.S. Pat. Nos. 3,796,402 to Trotta; 1,278,385 to Richard; 4,031,689 to Sullivan; 3,614,041 to Koger; 1,542,164 to Nelson; 4,413,800 to Kelson; and 4,069,993 to Shanks. None of the foregoing prior art teaches or suggests the particular trash bag holder of this invention.

SUMMARY OF THE INVENTION

The present invention accomplishes its desired objects by broadly providing a trash bag holder comprising a top circular support member and a bottom circular support member. A first and a second upper hinge means are secured to the top circular support member; and a first and second lower hinge means are secured to the bottom circular support member. A first leg means is pivotally connected to the first upper hinge means and to the first lower hinge means; and a second leg means is pivotally connected to the second upper hinge means and to the second lower hinge means.

It is therefore an object of the present invention to provide a trash bag holder.

These, together with the various ancillary objects and features which will become apparent to those skilled in the art as the following description proceeds, are attained by this novel trash bag holder, a preferred embodiment being shown with reference to the accompanying drawings, by way of example only, wherein:

BRIEF DESCRIPTION OF THE DRAWINGS

FIG. 5 is an enlarged side elevational view of one side of the upper hinge;

FIG. 6 is an enlarged side elevational view of another side of an upper hinge;

FIG. 7 is a top plan view of an upper hinge;

FIG. 8 is a partial enlarged perspective view of a top hinge having the upper section of a leg pivotally secured within the channel off the upper hinge;

FIG. 9 is a partial perspective view of the connecting point of the upper leg section pivotally secured to the lower leg section and slidably disposed within the bifurcated head of the lower leg section;

FIG. 10 is a partial exploded perspective view of a lower hinge having a lower leg section pivotally secured within the channel of the lower hinge;

FIG. 11 is a side elevational view of a lower section of the legs;

FIG. 12 is an end elevational view of the lower section of FIG. 11;

FIG. 13 is a side elevational view of the upper section of the leg;

FIG. 14 is an end elevational view of the upper section of FIG. 13;

FIG. 15 is an enlarged top plan view of the trash bag holder of FIG. 1;

DETAILED DESCRIPTION OF THE INVENTION

Figure 1:
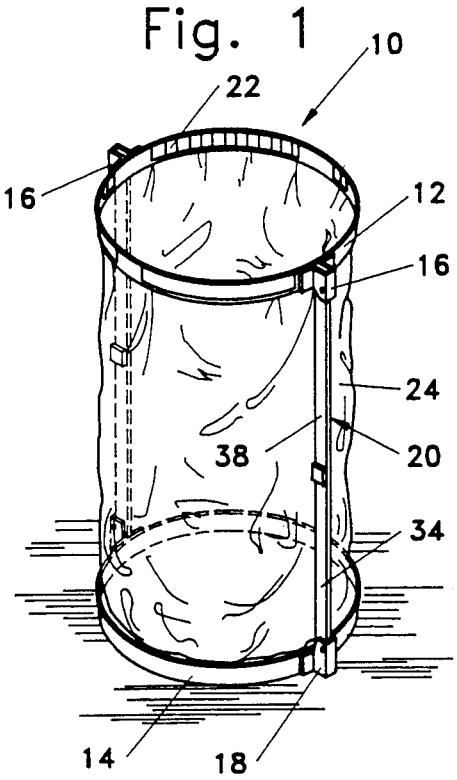
FIG. 1 is a perspective view of the trash bag holder holding a bag in an upright position.
Figure 16:
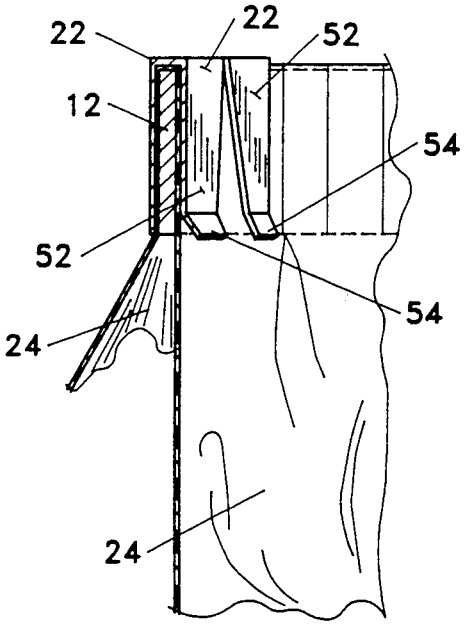
FIG. 16 is a vertical sectional view taken in direction of the arrows and along the plane of line 16—16 in FIG. 15.
Figure 17:
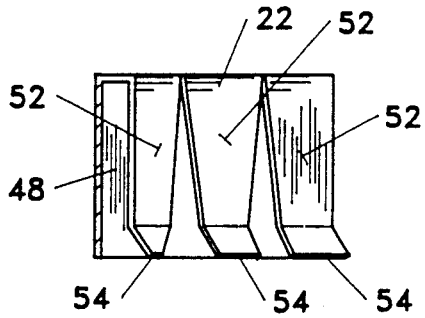
FIG. 17 is a vertical section view taken in direction of the arrows and along the plane of line 17—17 in FIG. 18.
Figure 18:
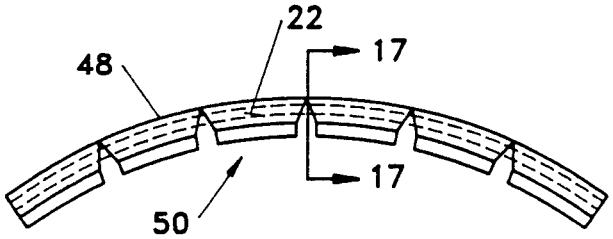
FIG. 18 is a top plan view of an arcuate clamp.
Figure 19:
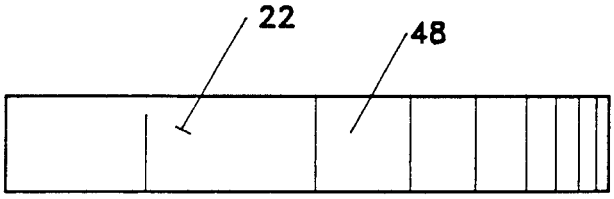
FIG. 19 is a front elevational view of the arcuate clamp of FIG. 18.
Figure 21:
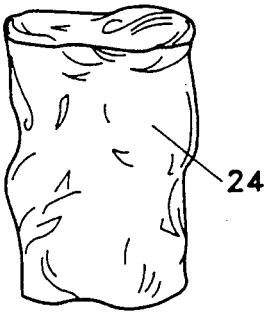
FIG. 21 is a perspective view of a filled trash bag after it has been filled employing the trash bag holder of this invention.
Figure 20:
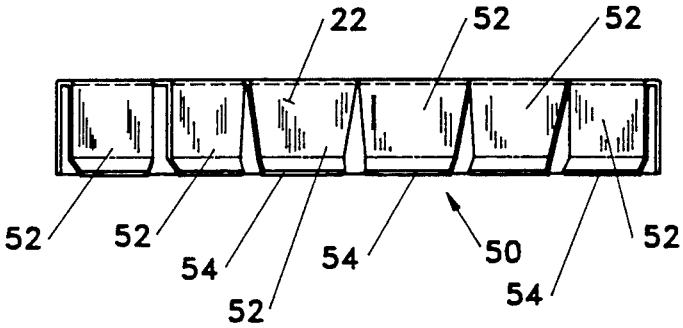
FIG. 20 is a rear elevational view of the arcuate clamp of FIG. 18.

Referring in detail now to the drawings wherein similar parts of the invention are identified by like reference numerals, there is seen a trash bag holder, generally illustrated as 10, having a top circular support member 12, and a bottom circular support member 14. The top circular support member 12 has a pair of upper hinges 16—16 secured thereto. Similarly, the bottom circular support member 14 has a pair of lower hinges 18—18 secured thereto. A pair of legs 20—20 pivotally connect to the upper hinges 16—16 and to the lower hinges 18—18. As will be more fully explained below, each of the legs 20—20 has a mid-point that defines a pivot such that the trash bag holder 10 can be collapsed into the collapsible position of FIG. 4. At least one arcuate clamp 22 is slidably disposed over the top circular support member 12 such that a flexible bag 24 can be retained on the top circular support member 12 as best illustrated in FIGS. 1 and 16.

The pair of upper hinges 16—16 and the pair of lower hinges 18—18 are identical in configuration. More specifically, each upper hinge 16 has a channel 26 and a pair of upper flanges 28—28 that are on the opposite or opposed sides of the channel 26 as shown in FIGS. 6 and 7.

As best shown in FIGS. 6 and 7, channel 26 is generally U-shaped and is defined by a channel bottom **26*b* and a pair of parallel channel sides 26*s*—26*s* secured fixedly or integrally to the channel bottom 26*b*. Each of the channel sides 26*s* has a channel sloping surface 26*ss* extending away from the upper flanges 28—28 towards the channel bottom 26*b*. The upper flanges 28—28 connect integrally to the top of the channel sides 26*s*—26*s* and extend outwardly therefrom. The faces of the upper flanges 28—28 connect to the top circular support member 12 such that the channel 26 faces towards the top circular support member 12 and is partially covered by the same. More specifically further, each lower hinge 18 has a channel 30 (see FIG. 10) and a pair of lower flanges 32—32 that are on opposite sides of the channel 30 as shown in FIG. 10**.

As best shown in FIG. 10, channel 30 is generally U-shaped and is defined by a channel bottom **30*b* and a pair of parallel channel sides 30*s*—30*s* secured fixedly or integrally to the channel bottom 30*b*. Each of the channel sides 30*s* has a channel sloping surface 30*ss* extending away from the lower flanges 32—32 towards the channel bottom 30***b*. The lower flanges 30—30 connect integrally to the top of the channel sides 30*s*—30*s* and extend outwardly therefrom. As also shown in FIG. 10, the faces of the lower flanges 32—32 connect to the bottom circular support member 14 such that the channel 30 faces towards the bottom circular support member 14 and is partially covered by the same.

Each leg 20 has a lower section 34 that pivotally connects at 36 to lower hinge 18 within channel 30 (see FIG. 10), and an upper section 38 that pivotally connects at 40 at upper hinge 16 within channel 26 (see FIG. 8). The upper section 38 pivotally connects to the lower section 34 at 41 as shown in FIG. 9. The lower section 34 terminates into a bifurcated head, generally illustrated as 42 (see FIGS. 11 and 12), having a channel 44 wherein the lower part of the upper section 38 slidably lodges to erect the leg 20 in an upright position. The bifurcated head 42 of each lower section 34 has a protruding lug 46 (see FIG. 9) that extends partially over the channel 44 such that the upper section 38 is releasably held within the channel 44 and can not be readily removed therefrom without snapping or forcing the upper section 38 out of the channel 44 and around the protruding lug 46. Preferably the lug 46 would be flexible and resilient in order to bend when the upper section 38 is pivoted into and out of the channel 44 of the head 42. The bifurcated head 42 is defined alternatively by a channel bottom 44*b* and a pair of channel sides 44*s*—44*s* secured integrally in a nonpivotal fashion to the channel bottom 44*b*. One of the channel sides 44*s* represents the top portion of the lower section 34. The protruding lug 46 connects integrally to the end of one of the channel sides 44*s*.

Each arcuate clamp 22 has an outside wall 48, and an inside wall, generally illustrated as 50, that includes or is made up of a plurality of trapezoidal shaped wall members 52 having a bottom edge 54 that is upturned and bent outwardly to facilitate the placing of the clamp 22 over the top circular support member 12 after the top of the bag 24 has been folded thereover such that the clamp 22 sandwiches the top portion of the bag 24 against the top circular support member 12 as illustrated in FIG. 16.

Figure 2:
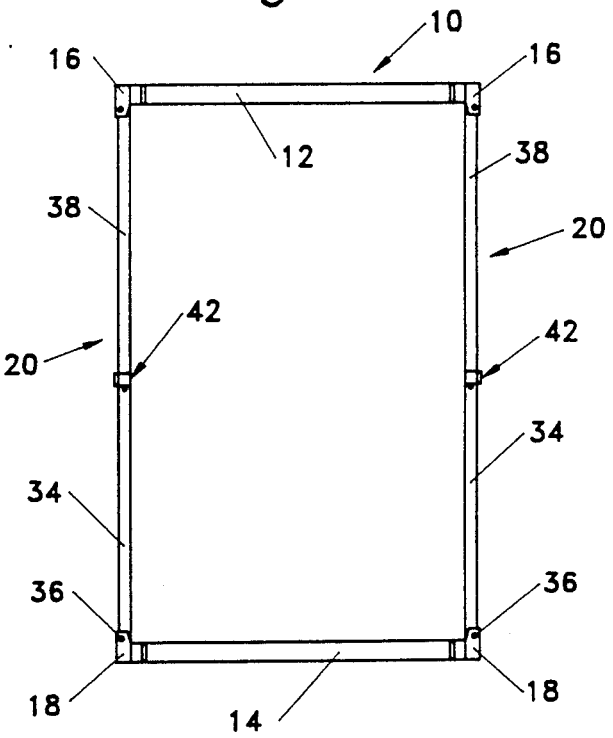
FIG. 2 is a side elevational view of the trash bag holder.
Figure 3:
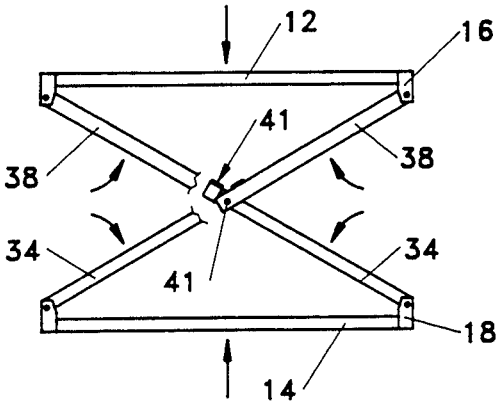
FIG. 3 is a side elevational view of the trash bag holder as it is being collapsed.
Figure 4:
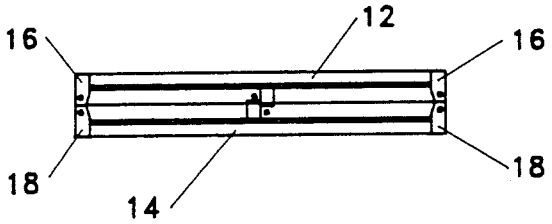
FIG. 4 is a side elevational view of the trash bag holder in a collapsed position.

With continuing reference to the drawings for operation of the invention, the trash bag holder 10, which is normally in the collapsed position of FIG. 4, is erected into the upright position of FIG. 2 by pulling or lifting the top circular support member 12 away from the bottom circular support member 14 causing each of the upper sections 38 to pivot at 40 and at 41, and causing each of the lower sections 34 to pivot at 36, as the legs 20 are being positioned to be straight or in a non-collapsed position. The support members 12 and 14 are continued to be pulled apart until each of the upper sections 38 of each leg 20 snap over or around lug 46 and lodge into the channel 44 of the head 42 of the lower section 34. Where both upper sections 38 are lodged in the respective channels 44 of the respective heads 42, the trash bag holder 10 is in the erect position of FIG. 2. The top of the bag 24 is subsequently folded over the top circular support member 12 and a plurality of the clamps 22 are slipped over the support member 12 to steadfastly hold the bag 24 around the support member 12 and in an open position as best shown in FIG. 1. After the bag 24 has been filled with any desired articles or substance such as grass, etc., the clamps 22 are removed and the filled bag 24 is separated from the bag holder 10 by merely passing the filled bag 24 through the bottom circular support member 12. The bag holder 10 can be collapsed back into the position of FIG. 4 by disengaging each of the upper sections 38 from within the channels 44 by forcing or urging the upper sections 38 around the resilient protruding lugs 46, and subsequently moving or compressing (see FIG. 3) the top support member 12 towards the bottom support member 14, causing the upper sections 38 to pivot at 40 and at 41 and causing the lower sections 34 to pivot at 36. Continual compression results in the trash bag holder 10 being in the collapsed position of FIG. 4, which is ideal for storing or transporting the trash bag holder 10.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope of the invention as set forth.

I claim:

1. A trash bag holder comprising a top circular support member; a bottom circular support member; a first and a second upper hinge means secured to said top circular support member; a first and second lower hinge means secured to said bottom circular support member; a first leg means pivotally connected to said first upper hinge means and to said first lower hinge means; and a second leg means pivotally connected to said second upper hinge means and to said second lower hinge means; said first leg means comprises a first lower leg section and a first upper leg section pivotally secured to said first lower leg section; said second leg means comprises a second lower leg section and a second upper leg section pivotally secured to said second lower leg section; said first lower leg section terminates in a first lower head having a structure defining a first lower head channel wherein a lower part of said first upper leg section slidably lodges; said first lower head additionally comprises a first lower lug means extending partially over the first lower head channel; said second lower leg section terminates in a second lower head having a structure defining a second lower head channel wherein a lower part of said second upper leg section slidably lodges; and said second lower head additionally comprises a second lower lug means extending partially over said second lower head channel; and additionally comprising at least one arcuate clamp means slidably disposed over said top circular support member, said arcuate clamp means having an outside wall and an inside wall integrally bound to said outside wall, said inside wall having a structure defining a plurality of trapezoidal shaped wall members with an upturned edge.

2. The trash bag holder of claim 1 wherein said first upper hinge means has a structure defining a first upper channel and a pair of first upper flanges opposed with respect to each other on opposite sides of said first upper channel, said pair of first upper flanges connect to said top circular support member such that a portion of said first upper channel is covered by said top circular support member.

3. The trash bag holder of claim 1 wherein said second upper hinge means has a structure defining a second upper channel and a pair of second upper flanges opposed with respect to each other on opposite sides of said second upper channel, said pair of second upper flanges connect to said top circular support member such that a portion of said second upper channel is covered by said top circular support member.

4. The trash bag holder of claim 1 wherein said first lower hinge means has a structure defining a first lower channel and a pair of first lower flanges opposed with respect to each other on opposite sides of said first lower channel, said pair of first lower flanges connect to said bottom circular support member such that a portion of said first lower channel is covered by said bottom circular support member.

5. The trash bag holder of claim 1 wherein said second lower hinge means has a structure defining a second lower channel and a pair of second lower flanges opposed with respect to each other on opposite sides of said second lower channel, said pair of second lower flanges connect to said bottom circular support member such that a portion of said second lower channel is covered by said bottom circular support member.

* * * * *